United States Patent [19]

Hinton

[11] 4,272,860

[45] Jun. 16, 1981

[54] DRAIN AUGER CONTROLLING TOOL

[76] Inventor: John R. Hinton, W340 N8121 Town Line Rd., Oconomowoc, Wis. 53066

[21] Appl. No.: 121,828

[22] Filed: Feb. 15, 1980

[51] Int. Cl.[3] ..... B08G 9/06

[52] U.S. Cl. ..... 15/257 R; 15/104.3 SN; 254/134.3 FT

[58] Field of Search ..... 15/104.3 SN, 257; 254/134.3 FT

[56] References Cited

U.S. PATENT DOCUMENTS

| | | | |
|---|---|---|---|
| 1,545,896 | 7/1925 | Hanlon | 15/104.3 SN X |
| 1,638,766 | 8/1927 | Grosvold | 15/104.3 SN |
| 1,982,402 | 11/1934 | Shade | 15/104.3 SN |
| 2,323,727 | 7/1943 | Robinson et al. | 15/104.3 SN X |
| 2,410,753 | 11/1946 | Shinomiya | 175/82 |
| 2,819,480 | 1/1958 | Kollman | 15/104.3 SN |
| 2,887,703 | 5/1959 | Williams | 15/104.3 SN |

*Primary Examiner*—Chris K. Moore

*Attorney, Agent, or Firm*—James E. Nilles; James R. Custin

[57] ABSTRACT

A drain auger guiding tool comprises an elongated rigid body having at its front a reaction surface facing to one side of the body. A medial portion of an auger is engaged against that surface while a more rearward portion of the auger extends along the body at said side of it, and a more forward portion is flexed around the front end of the body, toward its other side, by an auger flexing hook swingable about an axis near the front of the body. For swinging the hook, a tension rod extends along said other side of the body and has an actuator at its rear end and a supple eccentric connection with the hook at its front end.

5 Claims, 4 Drawing Figures

DRAIN AUGER CONTROLLING TOOL

FIELD OF THE INVENTION

This invention relates to apparatus for clearing clogged drains in plumbing systems and is more particularly concerned with a tool for guiding a drain auger around a sharp bend in a drain duct or into a desired branch duct at a drain duct junction.

BACKGROUND OF THE INVENTION

The well known drain auger or plumber's snake is a long, slender, springy device that is run lengthwise into a drain duct to break up a collection of solid or clotted material that is blocking flow through the drain. Usually such an auger consists of a single length of spring wire wound into small, uniform-diameter, closely spaced coils, and it is stiff enough to be pushed lengthwise into a drain duct but resilient enough to follow the curves in the duct. If the duct is fairly straight or has only gradual curves, the auger will usually move along it nicely, but because of its stiffness it resists following a sharp curve.

Even greater difficulty has heretofore arisen when the front end of a drain auger arrived at a junction of two ducts at some distance from a drain inlet, because there was no way to guide the auger into a selected one of the branches. Usually the front end of the auger could not be seen when it arrived at such a junction, and therefore even if the plan of the drain system was well known to the person using the auger, entry of the auger into the desired branch was more a matter of luck than of skill. Clearing a drain blockage is never enjoyable, but in such a situation the task could be frustrating, aggravating and time-consuming as well as lacking in esthetic appeal.

Maintenance personnel who are responsible for plumbing systems in commercial, industrial and office buildings are familiar with another problem that has often resulted from the inability to control a drain auger into a selected one of two or more branches in a drain system. Where several plumbing fixtures such as toilets or wash basins are connected to a common soil pipe a drain auger run into the drain system at any one location was likely to come out into one of the fixtures if it followed the wrong branch duct. Often the auger emerged into a fixture in another room, so that the user of the auger had no way of knowing that it was not only failing to accomplish its purpose but was possibly marring and chipping the fixture against which its leading end was whipping and banging.

Heretofore there has been no obvious solution to this problem. Several devices have been proposed whereby a cable or the like can be guided along a narrow, duct-like passage, as in U.S. Pat. No. 2,286,781 to Abramson et al and U.S. Pat. No. 2,727,721 to Pinkerton, but with these the cable was guided at an end at which it was being pulled.

U.S. Pat. No. 2,410,753, to Shinomiya, disclosed a device for drilling deep wells comprising a flexible sheath that had a drill bit projecting from its free lower end. A cable that extended along the sheath and slid in connections to the sheath at intervals along its length could be tensioned to curve the lower end portion of the sheath, but the sheath could only be curved towards its side along which the cable extended, and if the sheath had the flexibility of a drain auger, it would have been hard to position in rotation and would have afforded little or no control.

U.S. Pat. No. 2,973,537 to Simpson disclosed a drain auger guide which was essentially an adaptation of the principles of the drill guide of the Shinomiya patent.

U.S. Pat. No. 2,887,703 to Williams disclosed a drain auger guide that comprises a rigid tube with a flexible sheath projecting lengthwise from its front end. The auger proper extended through the tube and the sheath and forwardly beyond the sheath. A chain was connected between a ring that was relatively fixed on the rigid tube and another ring which could be locked to the sheath at any position along its length and which could be so adjusted along the sheath as to establish tension in the chain at the value needed for a desired curvature of the sheath. However, the device had to be adjusted when it was outside of the drain to be cleaned, and the user had to estimate the amount of curvature that would be needed for causing the auger to follow a critical part of the drain. This was impractical, because it is often impossible to know which way a drain curves at a distance from an inlet to it.

Other prior U.S. patents that are more or less pertinent to the general problem here under consideration are: No. 2,718,376, to Raney, which disclosed a device whereby a flexible probe could be guided into a conduit but which afforded no guidance to the part of the probe that was in the conduit; No. 3,623,701, to Dudley, which disclosed means for guiding a rope around a pulley of known radius; No. 1,261,444, to Schied, which disclosed a drain auger per se and evidenced no recognition of the problem here under consideration; and No. 1,219,049, to Sticklin, which related to a sprayer duct having an outlet end portion that could be curved to a desired radius by means of a "pull member" generally embodying the principle employed in the above discussed Shinomiya patent.

From this brief review of the state of the pertinent art, it will be apparent that the very common and extremely annoying problem to which the present invention is directed has persisted because there has heretofore been no obvious solution to it.

SUMMARY OF THE INVENTION

The general object of the present invention is to provide drain duct cleaning means that can be controlledly directed into a desired part of a drain duct at a location in the duct that is remote from an inlet thereto at a plumbing fixture or the like, and which can thus be readily directed to the site of a blockage to be cleared, without waste of time and effort and without incurring the risk that unsuccessful attempts to clear the blockage will result in damage to plumbing fixtures.

More specifically, it is an object of this invention to provide a guide tool for use in cooperation with a drain auger or plumber's snake, whereby the drain auger can be guided around a sharp curve in a drain system into which it is inserted, or guided into a selected one of two or more branch ducts in the drain system, and whereby such guidance can be effected by feel as the auger is fed into the drain, without the need for preliminary knowledge or estimates concerning the course that the auger will have to take as it progresses into the drain.

It is also a specific object of the invention to provide a tool for guiding a drain auger in its progress through a drain duct system, which tool can be manipulated from a location outside the drain duct system but while the auger is in the drain duct, so that the auger can be appropriately guided by feel as and when it reaches a sharp curve or duct junction.

It is also a specific object of the invention to provide a drain auger guiding tool of the character described that can be readily controlled and manipulated with one hand while the other hand can be used to advance, rotate and otherwise manipulate the drain auger itself.

In general, these objects of the invention, and others which will appear from the following description, are achieved in a tool for flexing a front end portion of an elongated, slender, substantially springy drain auger in a desired direction while the auger is in a duct system, so that the auger can be caused to advance into a desired part of that system. The tool of this invention comprises a substantially rigid elongated body member with a front end having guide means thereon defining a reaction surface that has a substantially arcuate curve about an axis transverse to the length of the body member, said surface being engageable by a medial portion of an auger while a more rearward portion of the auger extends along said body member, substantially parallel thereto and at one side thereof. An auger flexing hook has a connection with the body member to be swingable substantially about said axis, and has an auger engaging portion which is spaced radially outwardly from said reaction surface and by which lateral force can be exerted upon a part of an auger that is forward of its said medial portion, to flex the auger around said surface from said one side of the body member toward said other side thereof. A tension member extends along the body member at said other side thereof, and said tension member has at its front end a connection with the auger flexing hook that is spaced from said connection of that hook with the body member. The tension member has actuating means at its rear end by which it can be drawn rearwardly, and it has a supple front end portion that can extend around said reaction surface and react against it to translate rearward movement of the tension number into swinging of the auger flexing hook from a position at said one side of the body member towards said other side thereof.

In a preferred embodiment of the invention, an elongated handle member is fixed to the body member near the rear end thereof and projects to one side of the body member, and said actuating means comprises a medially fulcrumed lever having a pivoted connection with said handle member that is spaced along the latter from the body member, said lever having one of its arms connected with the tension member while its other arm comprises a movable handle that is swingable towards said elongated handle member to impart rearward movement to said tension member.

BRIEF DESCRIPTION OF DRAWINGS

In the accompany drawings, which illustrate what is now regarded as a preferred embodiment of the invention.

DETAILED DESCRIPTION OF PREFERRED EMBODIMENT OF THE INVENTION

Figure 1:
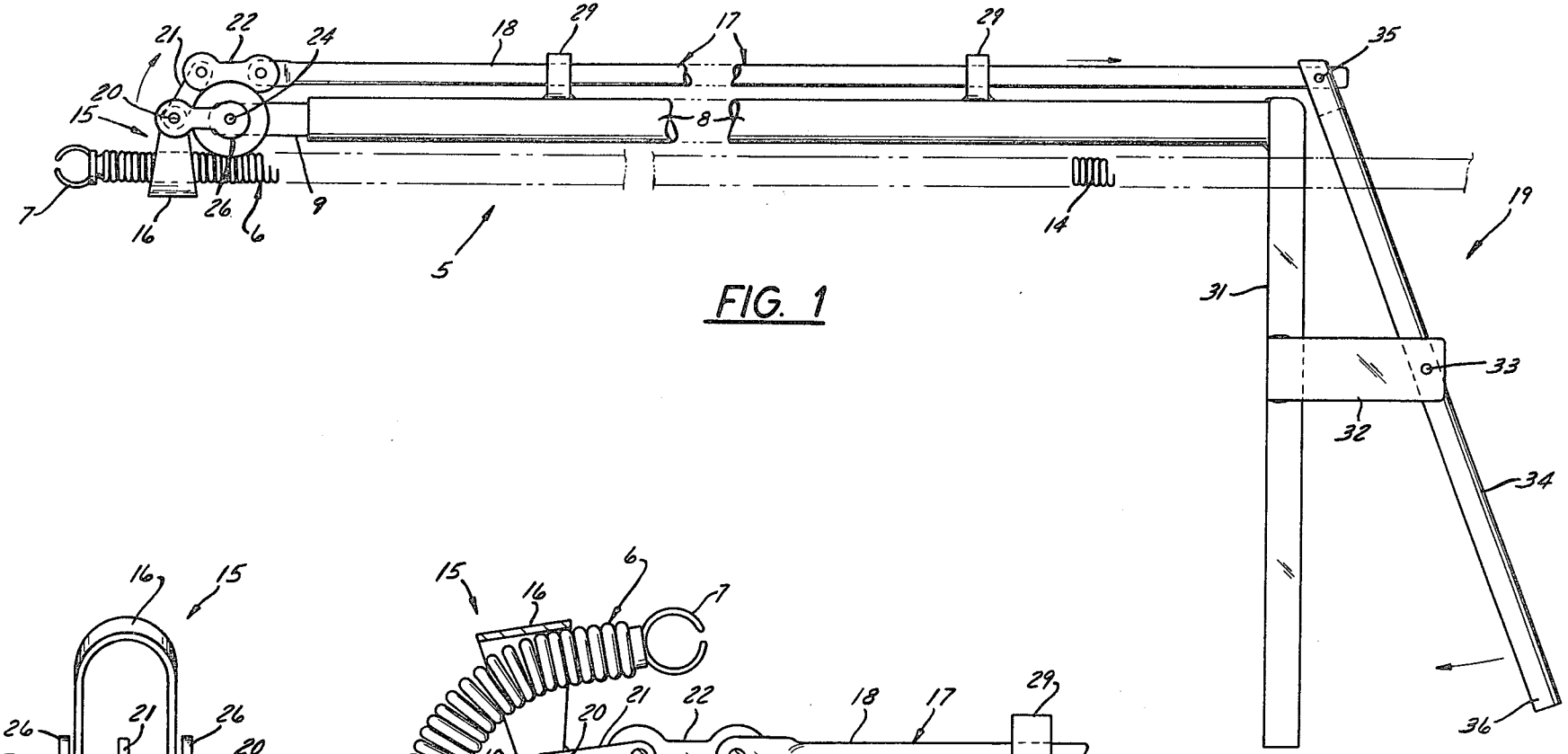
FIG. 1 is a plan view of the tool of this invention shown in operative relationship to a drain auger and with the tool in the condition for insertion of the auger into a drain duct.

Referring now to the accompanying drawings, the numeral 5 designates generally a tool that embodies the principles of this invention, intended for cooperation with a drain auger 6. The drain auger 6 can be of any conventional type, usually comprising a single length of fairly heavy spring wire formed into uniform, closely adjacent coils to comprise a long, slender spring that is stiff enough to move ahead when pushed into a drain duct or the like but is sufficiently flexible to accommodate itself to curves in the duct. The front end of the auger is formed as a hook 7 or the like to be effective in breaking up masses of paper, grease and similar materials that usually cause drain blockages. At its rear end (not shown) the auger conventionally has a crank or the like by which it can be rotated to encourage its advance into a drain and to enable the hook 7 to chew into blockage accumulations.

In general, the guide tool 5 of this invention has an elongated, substantially straight and rigid body member 8 which can comprise a tube or light, stiff rod about 30 in. long. At its front end the body member 8 is formed as a lug 9 that rotatably supports coaxial, substantially frusto-conical wheel members 10 and cooperates with them to define a reaction surface 11 that has a substantially arcuate curve about an axis which is transverse to the length of the body member. In this case the axis about which the reaction surface 11 curves is that of the frustoconical wheel members 10, and the reaction surface is defined by peripheral portions of those wheel members in cooperation with a rounded front end surface 12 of the lug-like portion 9 of the body member. The reaction surface 11 is engageable by a medial portion of the auger 6, while a more rearward substantially straight and unflexed length 14 of the auger extends along the body 8 at one side thereof.

The tool 5 also comprises an auger flexing hook 5 which has a connection with the front end portion of the body member whereby an auger engaging portion 16 of that hook is swingable substantially about the above mentioned axis, from the side of the body along which the rearward auger portion 14 extends to the opposite side thereof. As here shown, the auger flexing hook 15 has a substantially U-shaped auger engaging portion 16, which is spaced radially outwardly from the reaction surface 11 by a distance such that the auger 6 can be loosely received between its bight portion and the reaction surface. The auger is held captive by the hook 15 as that hook swings to flex the auger around the reaction surface 11 and thus point the free front end portion of the auger in a desired direction.

The hook 15 is actuated for its swinging motion by means of a tension member 17 that extends along the tool body 8 at the side thereof that is opposite the rearward auger portion 14. As here shown, and as is preferred, the tension member comprises a light rod 18 which extends substantially to the rear end of the body member 8, where actuating means 19, described hereinafter, enable the user of the tool to draw the tension member rearwardly relative to the body. At its front end the tension member 17 has a connection 20 with the auger flexing hook 15, which connection is spaced from the axis about which the hook 15 swings. Furthermore, the front end portion of the tension member 17 is relatively supple—in this case comprising a pair of links 21, 22—to extend around the reaction surface 11 and cooperate with it in translating rearward movement of the tension member into swinging motion of the auger flexing hook 15 towards the side of the body 8 at which the tension member 17 is located.

Considering the structure in more detail, the lug-like front end portion 9 on the body member has opposite flat surfaces 23 which are normal to the axis of the frustoconical wheel members 10. The wheel members, which respectively overlie those surfaces 23, are rotatably connected to the body member 8 by means of a pin 24 that extends through a hole in the lug-like body portion 9 and coaxially through the wheel members. The wheel members 10 taper towards one another so that the arcuately curved reaction surface 11 which they define forms a circumferential, radially outwardly opening groove in which the auger 6 is confined against lateral motions in directions parallel to the wheel axis. Stated another way, the two wheel members 10 cooperate to define a pulley-like structure having opposite, radially outwardly projecting flanges 25 that extend around the surface 11 and between which the auger is confined.

Overlying the flat, axially outer faces of the wheel members 10 are a pair of links 26 which comprise a part of the auger flexing hook 15 and each of which has at one of its ends a swinging connection with the pin 24 that serves as the axle for the wheels. The links 26 extend radially beyond the peripheries of the wheel members 10. A pin 27 that extends through the outer ends of the links 26, parallel to the axis about which they swing, maintains the links parallel to one another; and it also extends through holes in the legs of the U-shaped auger engaging portion 16 of the auger flexing hook, to provide a connection between the links and that U-shaped member whereby the latter is swingable relative to the links 26, at least to a limited extent. The front link 21 of the pair of links connecting the tension member rod 18 with the auger flexing hook 15 has at its front end a pivotal connection with the pin 27.

Figure 2:
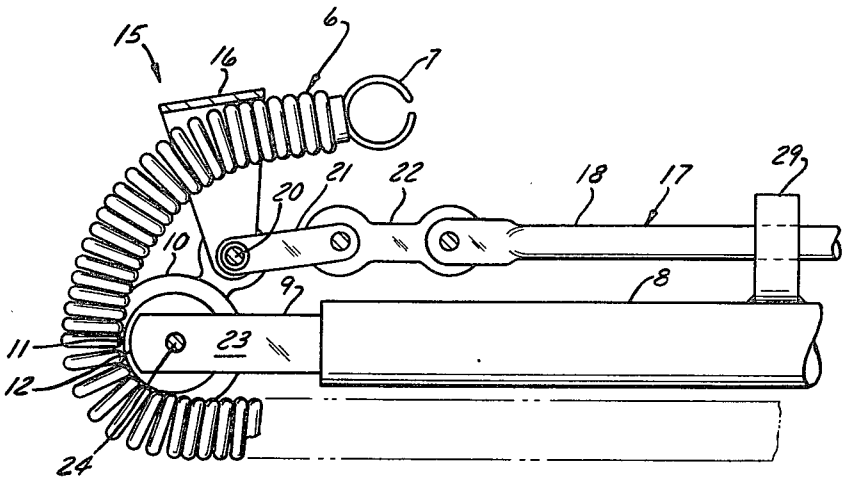
FIG. 2 is a fragmentary plan view on an enlarged scale showing the front end of the tool in a condition in which it disposes an associated auger to accommodate a sharp bend.
Figure 3:
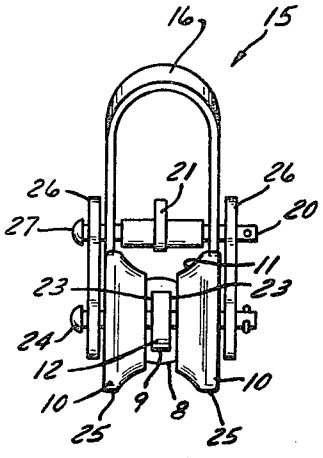
FIG. 3 is a front end view of the tool in substantially the condition in which it is shown in FIG. 2, but with the auger removed.
Figure 4:
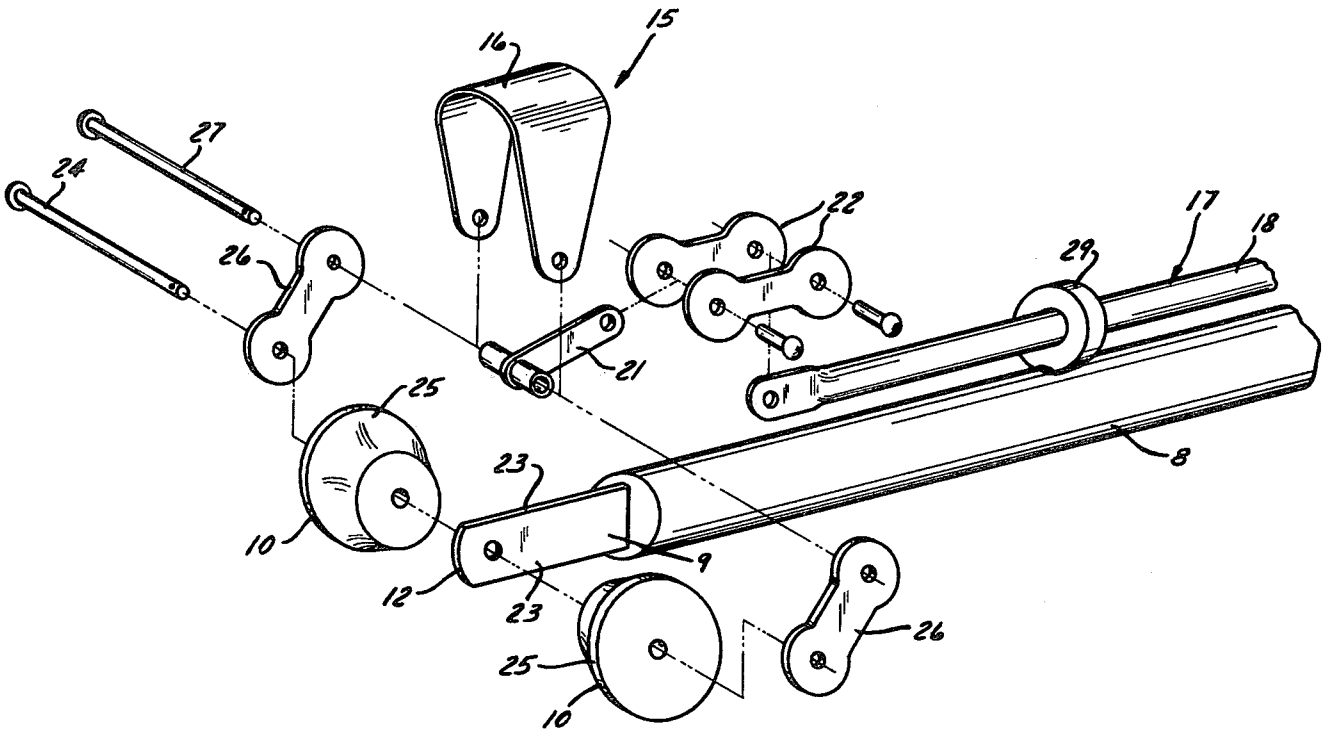
FIG. 4 is a disassembled perspective view of the front portion of the tool.

As can be seen from a comparison of FIG. 1 with FIG. 2, the connection between the links 26 and the U-shaped auger engaging member 16 is such that the latter engages an auger a small distance forward of where the auger engages the reaction surface 11. Thus, as the auger is flexed about the reaction surface 11, it also tends to be drawn lengthwise forwardly around that surface, and such forward motion of the auger is facilitated by rotation of the frustoconical wheel members 10, which also serve as bearings for the auger hook links 26 in addition to cooperating with the tension links 21, 22 in producing swinging of the auger flexing hook 15 as explained above. The girth of the U-shaped portion 16 of the auger flexing hook is substantially larger than the diameter of a conventional auger so that the auger can be worked lengthwise back and forth through the U-shaped member.

The rod portion 18 of the tension member 17 is confined to substantially axial motion parallel to the body member 8 by means of guide eyes 29 which are secured to the body member at intervals along it and through which the rod portion 18 extends.

Near the rear end of the body 8 there is a lateral projection 31, preferably extending to the side of the body remote from the tension member 17, which projection comprises a relatively fixed handle. A rearwardly extending bracket 32 on this projection 31, spaced a distance from the body 8, has at its rear end a pivotal connection 33 which provides a medial fulcrum for a lever 34 that comprises the actuating means 19 for the tension member 17. One arm of the lever 34 has at its outer end a pivotal connection 35 with the rear end of the rod 18; the other arm of that lever comprises a movable handle 36 which is swingable towards and from the fixed handle 31. The connection 35 between the lever 34 and the rod 18 moves in an arc with swinging of that lever about its fulcrum 33, but the consequent lateral component of motion of the rod 18 can be accommodated by a loose fit of that rod in the guide eyes 29.

In using the tool of this invention, its handles 31, 36 are diverged to cause the auger flexing hook 15 to assume substantially its position shown in FIG. 1. The front end portion of an auger is moved axially through the auger flexing hook 15 until it projects a suitable distance beyond that hook. The tool 5 can then be held in one hand while a rear portion of the auger 6 is held in the other hand to steady the auger, and the tool and auger together are then inserted into the drain to be cleared.

Converging the handles 31 and 36 flexes the auger 6 around the reaction surface 11. Owing to the resilience of the auger, it tends to straighten when convergent force is relaxed. If some converging force is maintained on the handles 31, 36 as the tool is advanced into a drain, the front end portion of the auger will be more or less clamped to the tool, to constrain the auger to move with the tool. However, the auger can at any time be lengthwise advanced or drawn back relative to the tool by relaxing the converging force on the handles.

Furthermore, maintenance of some converging force on the handles 31, 36 as the tool is moved into the drain maintains the front end of the auger flexed into engagement with the wall of the drain so that the auger serves as a feeler by which a junction with a desired branch drain duct can be detected. By means of the handles 31, 36, the tool and the auger can be easily rotated, and because the handles 31, 36 point away from the directions in which the auger is flexed, the orientation of the auger tip portion is always known to the user.

From the foregoing description taken with the accompanying drawings it will be apparent that this invention provides a convenient and easily used tool by which a drain auger can be guided as it is being advanced into a drain duct and which enables the user to feel for the location of a drain duct junction and direct the auger into a selected one of the duct branches at the junction.

What is claimed as the invention is:

1. A tool for flexing a front end portion of an elongated, slender, substantially springy drain auger in a desired direction while the auger is in a duct system so that the auger can be caused to advance into a desired part of that system, said tool comprising:

A. a substantially rigid elongated body member;

B. guide means on a front end of said body member defining a reaction surface that has a substantially arcuate curve about an axis transverse to the length of the body member, said surface being engageable by a medial portion of an auger while a more rearward portion of the auger extends along said body member, substantially parallel thereto and at one side thereof;

C. an auger flexing hook member having a connection with the body member to be swingable substantially about said axis and having an auger engaging portion which is spaced radially outwardly from said reaction surface and by which lateral force can be exerted upon a part of an auger that is forward of its said medial portion, to flex the auger around said surface from said one side of the body member toward said other side thereof; and D. a tension member extending along said body member at said other side thereof, said tension member
(1) having at its front end a connection with said hook member that is spaced from said connection of the hook member with the body member,
(2) having actuating means at its rear end by which it can be drawn rearwardly, and
(3) having a supple front end portion that can extend around said reaction surface and react thereagainst to translate rearward movement of the tension member into swinging of the hook member from a position at said one side of the body member towards said other side thereof.

2. The tool of claim 1, further characterized by:
said guide means further defining flanges at axially opposite sides of said reaction surface whereby an auger engaged with said surface is confined against lateral motion in directions parallel to said axis.

3. The tool of claim 1, further characterized by:
said guide means comprising
(1) a lug-like front end portion on said body member having opposite side surfaces normal to said axis, and
(2) a pair of coaxial substantially frustoconical wheel members connected to said plug-like portion for rotation about said axis, said wheel members overlying said opposite side surfaces and tapering towards one another to cooperate in defining a circumferential radially outwardly opening groove in which an auger is receivable to be substantially confined against lateral displacement in directions parallel to said axis.

4. The tool of claim 1, further characterized by:

E. an elongated handle member fixed to said body member near the rear end thereof and projecting to one side of the body member; and F. said actuating means comprising a medially fulcrumed lever having a pivoted connection with said handle member that is spaced along the latter from the body member,
(1) said lever having one of its arms connected with the rear end of said tension member, and
(2) the other end portion of said lever comprising a movable handle that can be swung towards said handle member for imparting rearward movement to said tension member.

5. A tool for flexing a front end portion of an elongated, slender, substantially springy drain auger in a desired direction while the auger is in a duct system so that the auger can be caused to advance into a desired part of that system, said tool comprising:

A. a substantially rigid elongated body member;

B. reaction means on a front end of said body member providing a surface which faces to one side of the body member and against which a portion of an auger that extends along the body member at said side thereof can be supported while a more forward portion of the auger is flexed around the front end of the body member in a direction towards the opposite side thereof;

C. an auger flexing hook having a connection with the body member near the front end thereof to be swingable therearound, said auger flexing hook having a portion which is spaced from said surface and arranged to embrace said more forward portion of an auger engaged with said surface and by its swinging motion flex the same; and D. a tension member extending along said body member, said tension member
(1) having at its front end a connection with said auger flexing hook whereby motion of the tension member in one direction lengthwise of the body member swings said auger flexing hook in the first mentioned direction, and
(2) having actuating means at its rear end by which it can be moved lengthwise of the body member.

* * * * *